US012134018B2

(12) United States Patent
Sullivan, III et al.

(10) Patent No.: US 12,134,018 B2
(45) Date of Patent: Nov. 5, 2024

(54) BASEBALL GRIP TRAINING DEVICE

(71) Applicant: Rip Grip Pro, LLC, Metairie, LA (US)

(72) Inventors: Edward Arthur Sullivan, III, Metairie, LA (US); Andrew Rand Avans, Metairie, LA (US)

(73) Assignee: Rip Grip Pro, LLC, Metairie, LA (US)

( * ) Notice: Subject to any disclaimer, the term of this patent is extended or adjusted under 35 U.S.C. 154(b) by 0 days.

(21) Appl. No.: 17/747,257

(22) Filed: May 18, 2022

(65) Prior Publication Data

US 2022/0370873 A1 Nov. 24, 2022

Related U.S. Application Data

(60) Provisional application No. 63/189,805, filed on May 18, 2021.

(51) Int. Cl.
*A63B 69/00* (2006.01)
*A63B 102/18* (2015.01)

(52) U.S. Cl.
CPC ..... *A63B 69/0002* (2013.01); *A63B 69/0059* (2013.01); *A63B 2069/0008* (2013.01); *A63B 2102/18* (2015.10)

(58) Field of Classification Search
CPC ..... A63B 69/0002; A63B 69/0059; A63B 2069/0008; A63B 2102/18; A63B 60/12
USPC ..... 473/458, 205, 206, 212, 409
See application file for complete search history.

(56) References Cited

U.S. PATENT DOCUMENTS 1,587,287 A * 6/1926 Denman ..... A63B 60/00 473/205
3,084,938 A * 4/1963 Kapanowski ..... A63B 60/10 473/568
4,615,046 A * 10/1986 Martin ..... A41D 13/087 2/21
5,704,845 A 1/1998 Boyte
5,867,868 A * 2/1999 Ward ..... A63B 60/10 294/171
6,389,596 B2 5/2002 Lomedico
6,532,594 B1 * 3/2003 Barnett ..... A41D 13/082 2/16
8,602,925 B1 12/2013 Rickon
9,987,534 B2 6/2018 Akin
2009/0313737 A1 * 12/2009 Richard ..... A63B 71/14 2/20
2011/0256992 A1 10/2011 Grafman et al.
2017/0361184 A1 12/2017 Roy
2017/0368431 A1 * 12/2017 Ward ..... A63B 60/14
(Continued)

*Primary Examiner* — Nini F Legesse
(74) *Attorney, Agent, or Firm* — Jones Walker LLP

(57) ABSTRACT

A baseball grip training device is provided for use with a baseball bat, comprising a base adapted to contact a bat grip, wherein the base includes one or more shaped surfaces adapted to receive one or more of an index finger and a middle finger of a user; a retaining member extending from the base shaped to surround one or more of the index finger and the middle finger of the user; and a bat contacting surface adapted to contact the bat grip, wherein the bat contacting surface and the shaped surfaces are separated by a predetermined distance to lift the index finger and the middle finger of the user away from the bat grip sufficient to place greater reliance on the remaining fingers to hold the bat grip during a swing of the bat. The device is preferably constructed from a resilient material.

17 Claims, 5 Drawing Sheets

(56) References Cited

U.S. PATENT DOCUMENTS

2020/0260806 A1* 8/2020 Paulson ..... A63B 60/22
2020/0352261 A1 11/2020 First

* cited by examiner

BASEBALL GRIP TRAINING DEVICE

CROSS-REFERENCE TO RELATED APPLICATIONS

This nonprovisional patent application claims the benefit of priority under 35 U.S.C. 119(e) to provisional patent application, U.S. Ser. No. 63/189,805, filed on May 18, 2021.

BACKGROUND OF THE INVENTION

1. Field of the Invention

The present invention relates to training devices used to help baseball players improve their swing of a baseball bat, and more particularly to such devices which are worn on the hand to adjust the grip on the bat during the swing.

2. Prior Art

In the sport of baseball, the accuracy and speed of the bat swing is an indispensable factor to player performance in the game, both in terms of imparting a high velocity to the ball as well as control of its direction and flight, i.e. grounder or fly ball. A baseball bat includes a grip held by the player with both the "strong" hand and the "weak" hand, where the strong hand corresponds to the whether the player is right-handed or left-handed. For example, the right hand is the strong hand for a right-handed player, and the weak hand is placed below the strong hand on the grip. Thus, during the swing of the bat, the weak (lower) hand and arm exert a pulling effect on the bat, while the strong (upper) hand and arm exert a pushing effect on the bat. For many players, especially those who are young and inexperienced, there is a tendency to apply too tight a grip with the strong hand, resulting in an exaggerated push of the bat through the swing as the barrel of the bat approaches the baseball. This pushing effect not only works against the pulling effect of the weak hand and arm, but it can also cause inaccurate swings and a decrease in rotational speed of the barrel around the wrist pivot point of the strong hand.

A well trained batter is often able to overcome the natural tendency to push the bat through the swing by placing greater reliance on the last two fingers of the strong hand, i.e. the pinky and ring finger. Doing so enables the barrel of the bat to more naturally rotate around the strong hand wrist pivot point, which means that the speed of the barrel as it approaches the baseball is the sum of the swing speed itself plus any rotational speed about the strong hand wrist pivot point. In other words, in a proper grip and swing, the barrel of the bat is caused to strike the baseball with greater speed and force than if the bat were pushed through the swing as described above.

Thus, in the training environment, the problem to be solved is to train the player to rely less on the index and middle fingers of the strong hand when grasping the grip of the bat, and to focus the player's attention on the ring and pinky fingers. While there are numerous grip-related devices in the prior art, none appear to address the biomechanics of lifting the index and middle fingers away from the grip of a baseball bat.

U.S. Pat. No. 9,987,534 shows a device used by a batter to connect the pinky finger of the upper hand with the index finger of the lower hand. While there are benefits to maintaining the relative positions of the upper and lower hands on the grip, that device does not include any structure that lifts the index and middle fingers from the grip of the bat.

U.S. Pat. No. 8,602,925 shows a device which is attached to the bat itself that offers a gripping portion for the index finger. It does not teach any benefits of lifting the index finger and middle fingers away from the grip of the bat, and it only improves the basic grip in a more general manner by supporting the index finger alone.

US 2020-0352261 shows a thumb-worn device that tries to address a completely different problem, i.e. bat "sting" and protection of the hand, and it does nothing to raise the index and middle fingers to address the pushing problem described above.

U.S. Pat. No. 6,389,596 shows another thumb-worn device, which is similar in most respects to the device in US 2020-0352261.

U.S. Pat. No. 1,587,287 is a device used in connection with golf clubs, and it includes some structural features to help the golfer improve the grip on the club. Specifically, that device is worn on the hand and has two holes for the pinky and ring fingers along with an extended portion that conforms to the club grip. The stated benefit is that it places the hand in the correct position on the grip, but it does not raise the index and middle fingers, and it does not address the goal of properly swinging the bat to achieve the fastest rotation prior to hitting the ball.

U.S. Pat. No. 4,615,046 shows a "shock absorber" worn on the hand when swinging a golf club. It appears to wrap around the index and middle fingers with Velcro so that those fingers are cushioned when the club strikes the ball. While it may be effective in cushioning the fingers upon impact of the club with the golf ball, it does not lift the index and middle fingers to achieve the goal of relying on the pinky and ring fingers in gripping a baseball bat, and there is no mention of the benefits of raising the fingers by any amount for the purposes of improving the speed of the club or a baseball bat.

As can be seen, the prior art fails to disclose a device which has both the structural and functional features necessary to achieve the training goals stated above. Therefore, the present invention addresses the training problem by providing a device which is worn on the index and middle fingers of the strong hand, lifts the index and middle fingers, and causes the player to rely on the pinky and ring fingers of the strong hand to grasp the grip of the bat during the swing to achieve greater control over the bat and increase the speed of the barrel upon contact with the baseball.

SUMMARY OF THE INVENTION

In summary, the present invention is a baseball grip training device for use with a baseball bat, comprising a base adapted to contact a bat grip, wherein the base includes one or more shaped surfaces adapted to receive one or more of an index finger and a middle finger of a user; a retaining member extending from the base shaped to surround one or more of the index finger and the middle finger of the user; and a bat contacting surface adapted to contact the bat grip, wherein the bat contacting surface and the shaped surfaces are separated by a predetermined distance to lift the index finger and the middle finger of the user away from the bat grip sufficient to place greater reliance on the remaining fingers to hold the bat grip during a swing of the bat.

In one embodiment, the retaining member surrounds both the index finger and the middle finger of the user.

In another embodiment, the retaining member surrounds only the index finger of the user.

Preferably, the predetermined distance between the shaped surfaces and the bat contacting surface is approximately one inch.

In another embodiment, the shaped surfaces include pockets formed into the base to receive the ends of the index finger and the middle finger of the user.

In another embodiment, the base includes a plurality of recesses formed into the base and adjacent to the bat contacting surface.

Preferably, the device is constructed from a resilient material.

These and other advantages of the present invention are explained in more detail in the following specification and drawings.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs. Unless otherwise specified herein, all materials of construction are preferably a resilient and durable material such as silicone.

Turning now to the figures, a number of preferred and alternate embodiments of the present invention are shown in FIGS. 1-5 which all employ structural features which lift the index and middle fingers from the surface of the bat grip.

Figure 1:
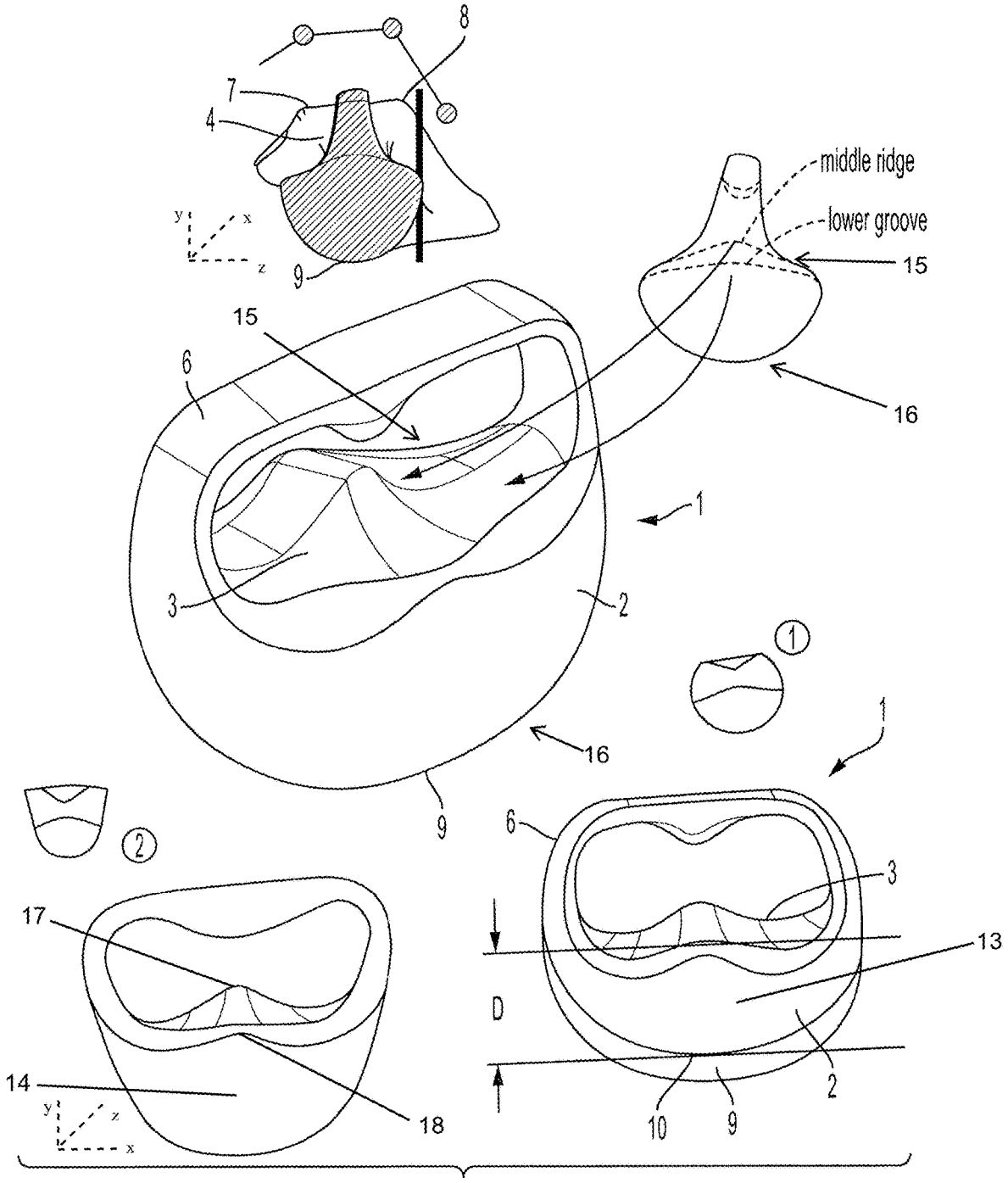
FIG. 1 shows a preferred and alternative embodiments of the present invention of a training device for gripping a bat.
Figure 2:
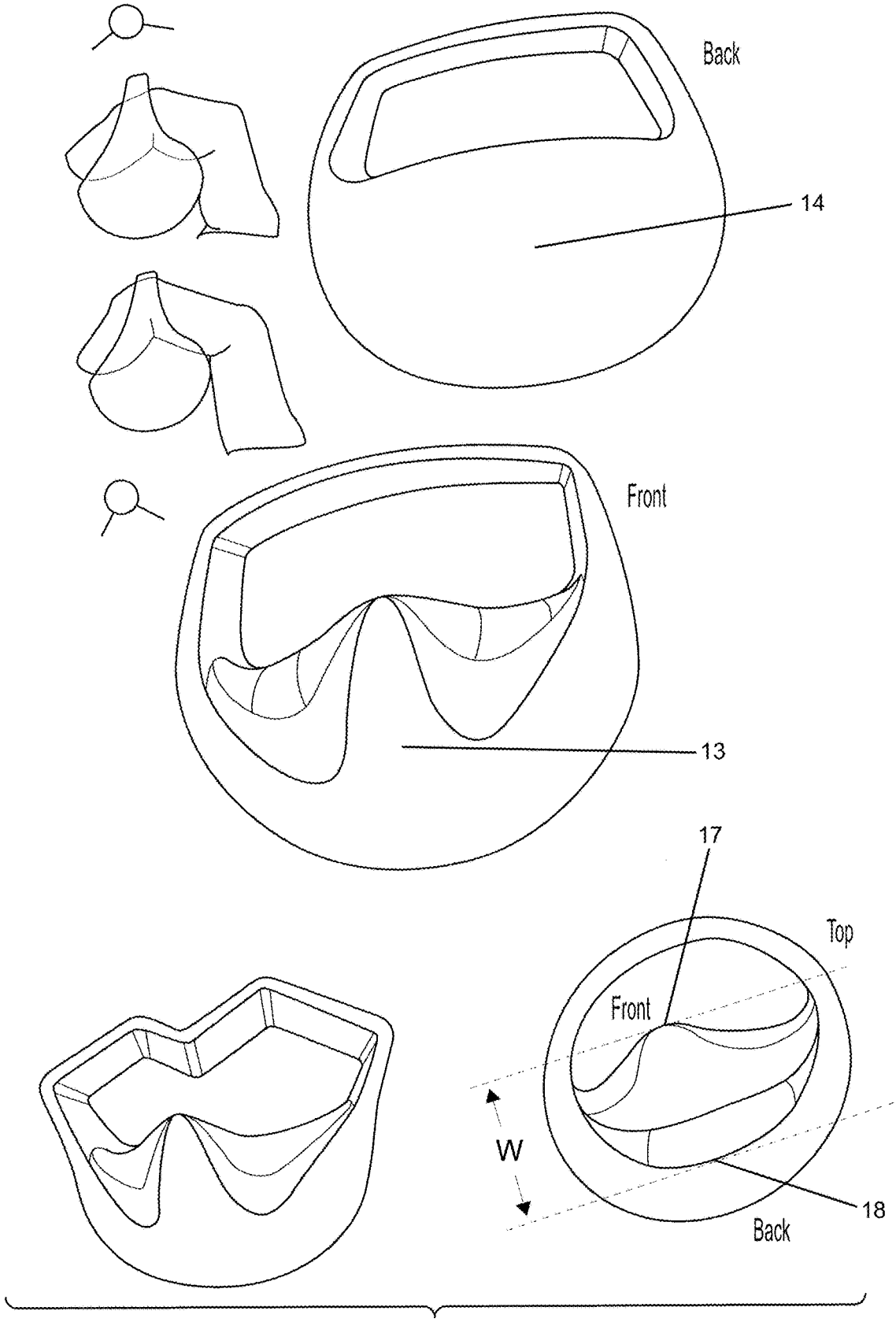
FIG. 2 shows additional embodiments of the present invention including various aesthetic and shape variations offering similar functionality.

With reference to FIG. 1, the training device 1 includes a base 2 having an upper face 15 adapted to receive a user's finger(s) and a lower face 16 for contacting a bat grip 10. The upper face 15 further includes internal shaped surfaces 3 for receiving and contacting the index and middle fingers 4, 5 of the strong hand. The upper face 15 and lower face 16 of the base 2 are connected by a front side surface 13 and a back side surface 14. As depicted in FIG. 1, the base 2 has a height defined by the distance between the lower face 16 and the upper face 15, a width defined by the distance across the front side surface 13 and back side surface 14, and a thickness defined by the distance between the front end 17 and the back end 18 of the internal shaped surfaces 3 formed on the upper face 15. A retaining member 6 extends from the base 2 to surround the index and middle fingers 4, 5 and positioned between the first and second knuckles 7, 8 from the tip of the fingers. The base 2 also includes a bat contacting surface 9, which may also include a convex groove 10 for conforming to the round shape of the bat grip 40. Importantly, the distance D from the bat contacting surface 8 and the internal shaped surfaces 3 defines the distance that the index and middle fingers 4, 5 are lifted from the bat grip 10 to achieve the aforestated training goals. The distance D is approximately one inch but can vary depending on the size of the device and the preferences of the user. FIG. 2 shows a number of additional embodiments having slightly different aesthetic elements and shapes, but with similar functional features.

Figure 3:
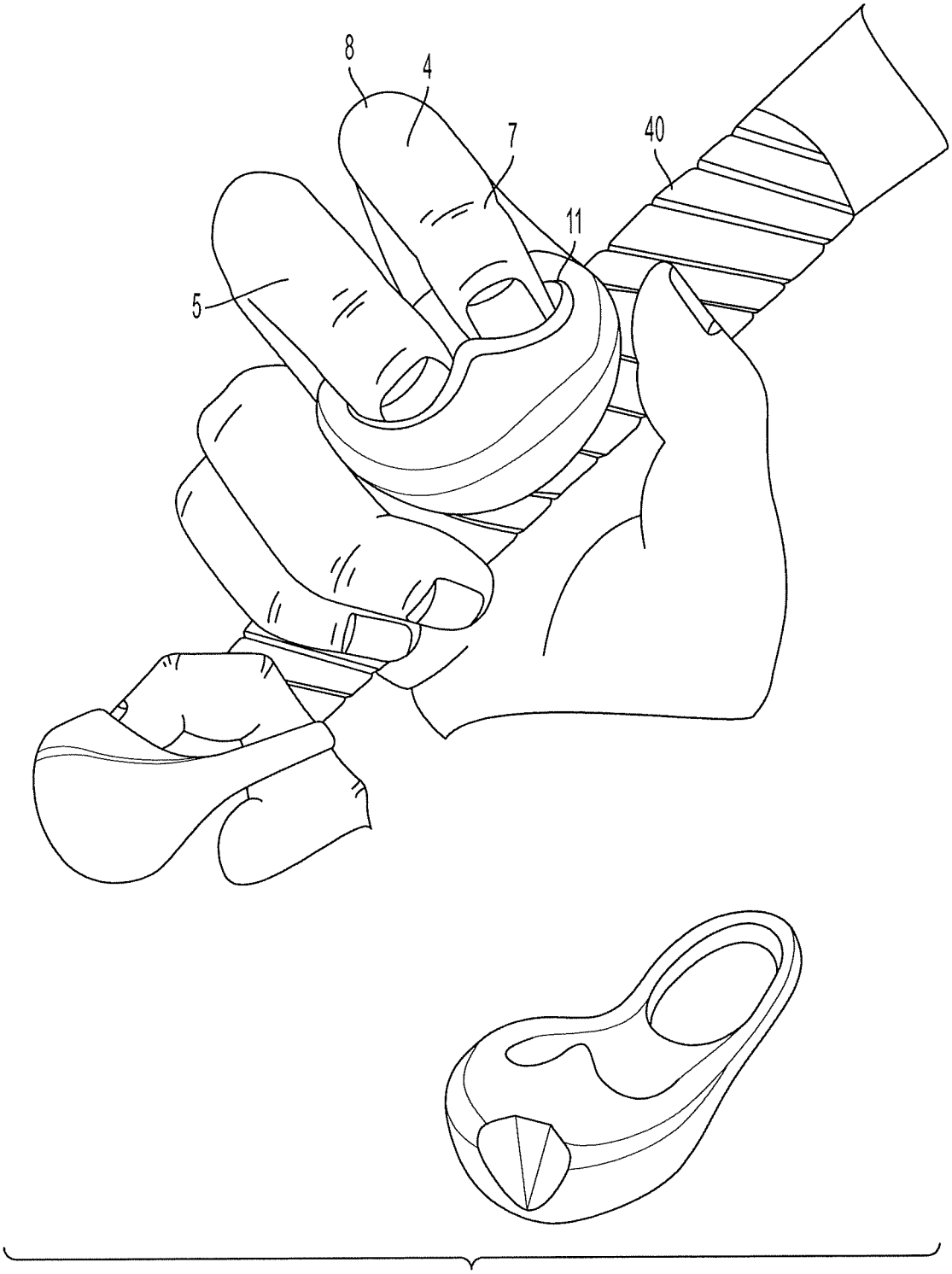
FIG. 3 shows an alternative embodiment of the invention, but which can be worn only on the index finger.

FIG. 3 shows an alternative embodiment which achieves a similar result, but which is worn only in the index finger 4 between the second and third knuckles of the strong hand. This embodiment further includes pockets 11 for receiving the tips of the index and middle fingers 4, 5. However, the distance D by which the fingers 4, 5 are lifted from the bat grip 40 is the same.

Figure 4:
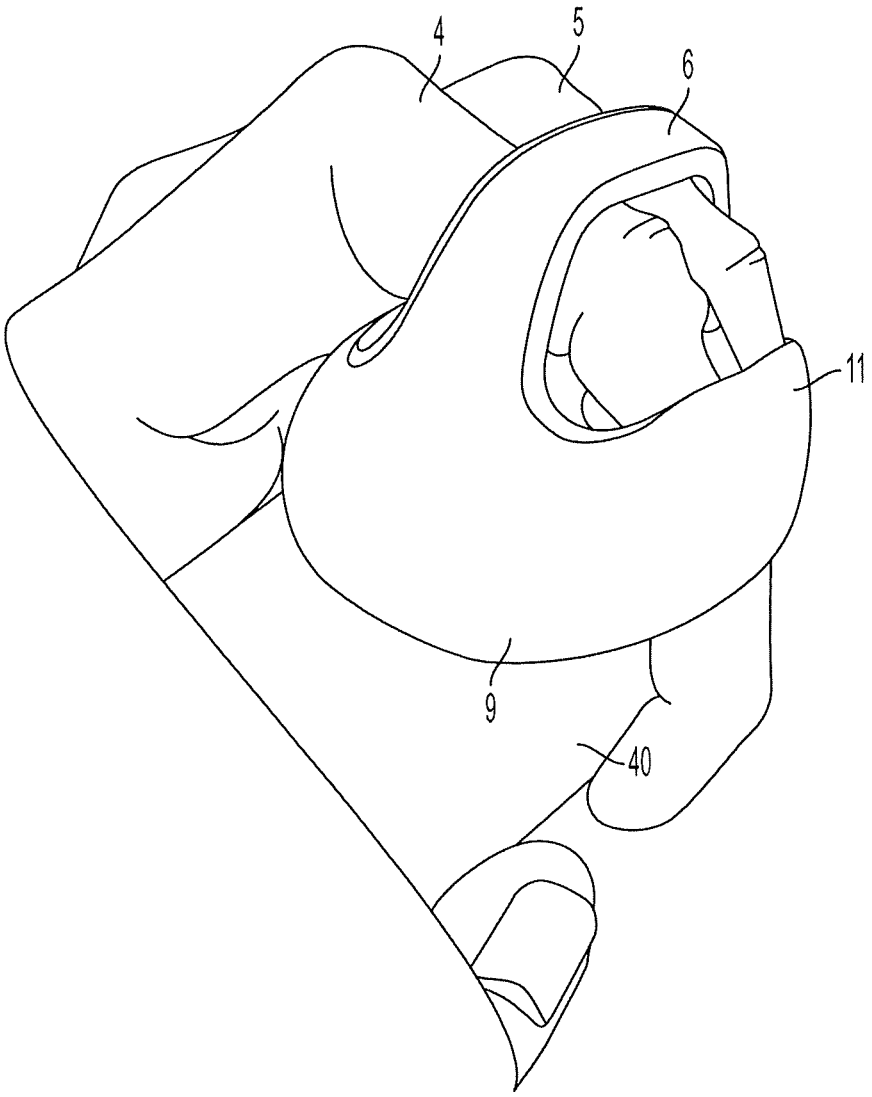
FIG. 4 shows another alternative embodiment of the invention having a pocket to retain the tips of the index and middle fingers.

FIG. 4 is still another embodiment of the invention shown on the left hand as the strong hand, and which also includes the finger pockets 11 of FIG. 3.

Figure 5:
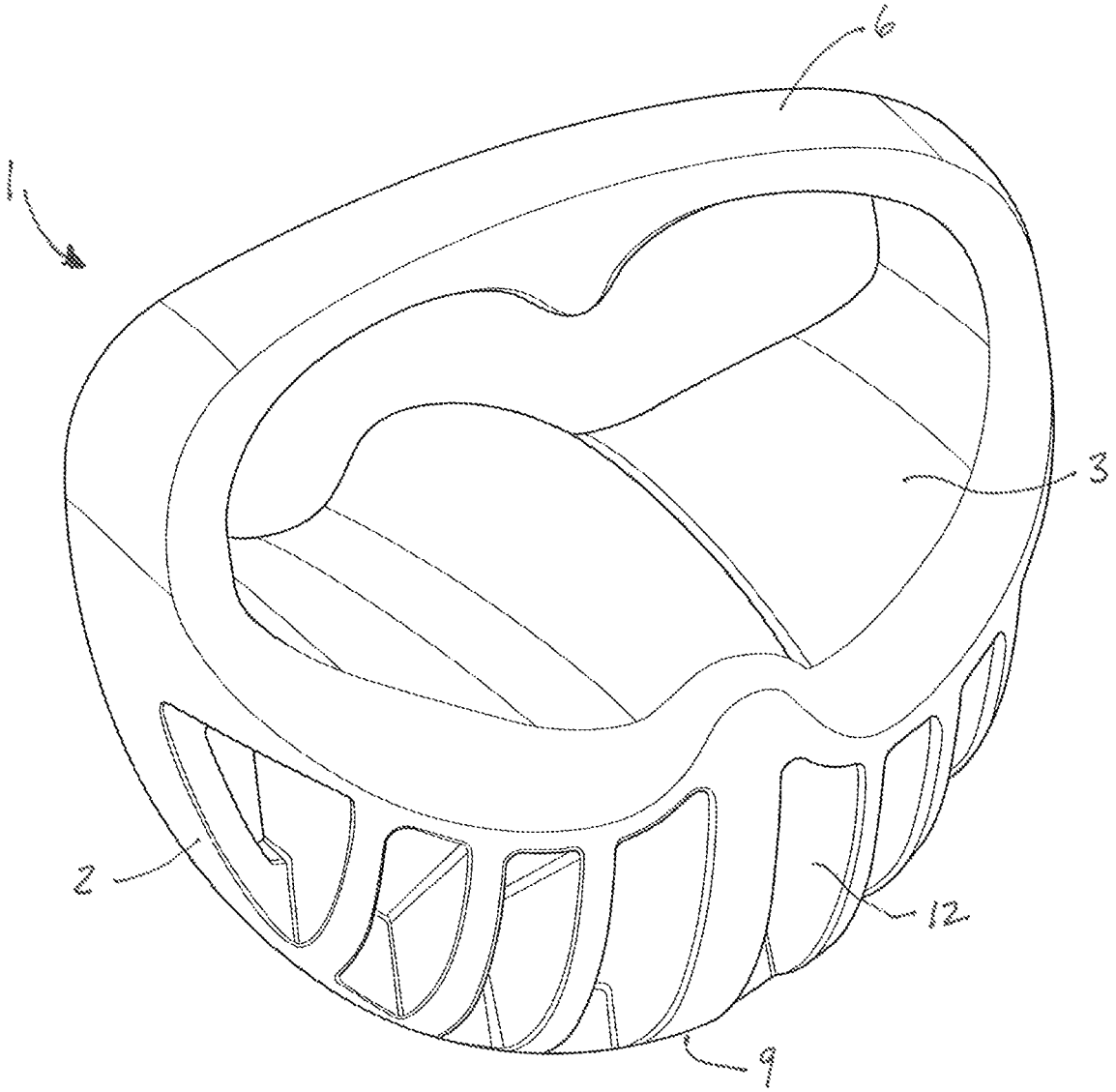
FIG. 5 shows another alternate embodiment of the invention having a plurality of recesses in the base adjacent to the bat contacting surface.

FIG. 5 is another embodiment of the invention shown with a plurality of recesses 12 formed into the base 2 and adjacent to the bat contacting surface 9. Because the device 1 is made from a resilient material, the recesses 12 allow the base 2 to further compress against the bat grip 40 during a swing.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A grip training device for use with a bat, comprising:

(a) a base adapted to contact a bat grip, the base having a width along an x-axis, a height along a y-axis, and a thickness along a z-axis, wherein the base includes:

(i) one or more shaped surfaces on an upper face of the base, wherein each shaped surface extends from a front end to a back end and is adapted to receive one or more of an index finger and a middle finger of a user only, wherein the thickness from the front end to the back end of each shaped surface is at least equal to a distance between a first knuckle and a second knuckle from a tip of the index finger or the middle finger of the user; and (ii) a bat contacting surface on a lower face of the base that opposes the upper face of the base, wherein the bat contacting surface is adapted to contact the bat grip, wherein the height of the base separates the bat contacting surface and the shaped surfaces by a predetermined distance that lifts the first knuckle from the tip of one or more of the index finger and the middle finger of the user away from the bat grip without lifting the remaining fingers to place greater reliance on the remaining fingers to hold the bat grip during a swing of the bat, wherein the bat contacting surface is connected to the front end and the back end of each shaped surface by a front side surface and a back side surface of the base, respectively, wherein the front side surface and the back side surface both have convex shapes; and (b) a retaining member extending from the base shaped to surround one or more of the index finger and the middle finger of the user.

2. The device of claim 1, wherein the retaining member surrounds both the index finger and the middle finger of the user.

3. The device of claim 2, wherein the shaped surfaces include grooves and a raised middle ridge between the grooves; and wherein the retaining member is not directly connected to the middle ridge of the shaped surfaces.

4. The device of claim 1, wherein the retaining member surrounds only the index finger of the user.

5. The device of claim 1, wherein the predetermined distance is approximately one inch.

6. The device of claim 1, wherein the shaped surfaces include pockets formed into the base to receive the tips of the index finger and the middle finger of the user.

7. The device of claim 1, wherein the base includes a plurality of recesses formed into the front side surface and back side surface of the base and adjacent to the bat contacting surface.

8. The device of claim 1, wherein the device is constructed from a resilient material.

9. The device of claim 1, wherein the generally flat distance of at least one of the shaped surfaces is sized to contact one or more of the index finger and the middle finger of the user at least from the first knuckle to the second knuckle.

10. A method of improving a user's swing of a bat, comprising the steps of:

(a) providing a grip training device, comprising: (i) a base adapted to contact a bat grip, the base having a width along an x-axis, a height along a y-axis, and a thickness along a z-axis, wherein the base includes one or more shaped surfaces on an upper face of the base, wherein each shaped surface extends from a front end to a back end and is adapted to receive one or more of an index finger and a middle finger of a user only, wherein the thickness from the front end to the back end of each shaped surface is at least equal to a distance between a first knuckle and a second knuckle from a tip of the index finger or the middle finger of the user; and a bat contacting surface on a lower face of the base that opposes the upper face of the base, wherein the bat contacting surface is adapted to contact the bat grip, wherein a height of the base separates the bat contacting surface and the shaped surfaces by a predetermined distance that lifts the first knuckle from the tip of one or more of the index finger and the middle finger of the user away from the bat grip without lifting the remaining fingers to place greater reliance on the remaining fingers to hold the bat grip during a swing of the bat, wherein the bat contacting surface is connected to the front end and the back end of each shaped surface by a front side surface and a back side surface of the base, respectively, wherein the front side surface and the back side surface both have convex shapes; and (ii) a retaining member extending from the base and shaped to surround one or more of the index finger and the middle finger of the user;

(b) positioning the grip training device on a strong hand of the user, wherein one or more of the user's index finger and middle finger only are positioned on the one or more shaped surfaces, wherein the retaining member is positioned between the first knuckle and the second knuckle from the tip of the user's index finger or middle finger;

(c) directing the user to swing a bat with the grip training device positioned on the user's strong hand, wherein the bat contacting surface of the grip training device engages a bat grip of the bat, and wherein the grip training device lifts the first knuckle from the tip of one or more of the user's index finger and middle finger away from the bat grip without lifting the remaining fingers to place greater reliance on the remaining fingers to hold the grip of the bat.

11. The method of claim 10, wherein in step (b) the retaining member is positioned between the first knuckle and the second knuckle from the tip of the user's index finger and middle finger, and wherein in step (c) the grip training device lifts the first knuckle from the tip of the user's index finger and middle finger away from the grip of the bat without lifting the remaining fingers.

12. The method of claim 11, wherein in step (a) the shaped surfaces include a middle ridge, and wherein in step (b) the middle ridge is positioned between the user's index finger and middle finger.

13. The method of claim 10, wherein in step (b) the retaining member is positioned between the first knuckle and the second knuckle from the tip of the user's index finger only, and wherein in step (c) the grip training device lifts the first knuckle from the tip of the user's index finger only away from the grip of the bat without lifting the remaining fingers.

14. The method of claim 10, wherein in step (a) the predetermined distance is approximately one inch.

15. The method of claim 10, wherein in step (a) the base includes a plurality of recesses formed into the front side surface and the back side surface of the base and adjacent to the bat contacting surface, and wherein in step (c) the plurality of recesses allow the base to compress against the bat grip.

16. The method of claim 10, wherein in step (a) the device is constructed from a resilient material.

17. The method of claim 10, wherein in step (b) the shaped surfaces contact one or more of the user's index finger and middle finger at least from the first knuckle to the second knuckle.

* * * * *